US007678208B2

(12) United States Patent
Bodin

(10) Patent No.: US 7,678,208 B2
(45) Date of Patent: Mar. 16, 2010

(54) METHOD OF HOT STAMPING AND HARDENING A METAL SHEET

(75) Inventor: Hans Bodin, Sodra Sunderbyn (SE)

(73) Assignee: Gestamp Hardtech AB, Lulea (SE)

( * ) Notice: Subject to any disclaimer, the term of this patent is extended or adjusted under 35 U.S.C. 154(b) by 416 days.

(21) Appl. No.: 11/663,239

(22) PCT Filed: Oct. 4, 2005

(86) PCT No.: PCT/SE2005/001465

§ 371 (c)(1),
(2), (4) Date: Mar. 19, 2007

(87) PCT Pub. No.: WO2006/038868

PCT Pub. Date: Apr. 13, 2006

(65) Prior Publication Data

US 2007/0261769 A1 Nov. 15, 2007

(30) Foreign Application Priority Data

Oct. 4, 2004 (SE) ..... 0402382

(51) Int. Cl.
*C21D 8/00* (2006.01)
*C21D 9/00* (2006.01)

(52) U.S. Cl. ..... 148/648; 148/624; 148/627; 148/559; 266/119; 266/249; 266/115; 293/133

(58) Field of Classification Search ..... 148/648
See application file for complete search history.

(56) References Cited

U.S. PATENT DOCUMENTS

| | | | | |
|---|---|---|---|---|
| 3,972,744 | A | 8/1976 | Cantrell | |
| 4,010,969 | A * | 3/1977 | Cantrell et al. | 293/102 |
| 5,916,389 | A | 6/1999 | Lindstrom | |
| 6,293,134 | B1 | 9/2001 | Johnson | |

FOREIGN PATENT DOCUMENTS

| | | |
|---|---|---|
| FR | 2671749 | 7/1992 |
| GB | 1490535 | 11/1977 |

OTHER PUBLICATIONS

Database WPI Week 200382 Derwent Publications Ltd., London, GB; AN 2003-889891 & JP 20 03328031 A (Nissan Motor Co LTD), Nov. 19, 2003, abstract, fig 2.
Database WPI Week 200432 Derwent Publications Ltd., London, GB; AN 2004-344109 & JP 20 04114912 A (Hirata KK et al), Apr. 15, 2004, abstract, fig 4.
Database EPODDC/EPO abstract & JP 61 099629 A (Nippon Steel Corp) May 17, 1986.

* cited by examiner

*Primary Examiner*—Roy King
*Assistant Examiner*—Christopher Kessler
(74) *Attorney, Agent, or Firm*—Mark P. Stone

(57) ABSTRACT

In the press hardening process when a blank is formed and cooled in cooled tools (30,31), the tools are used as a fixture during the hardening. The tools have alternately contact surfaces (33,34) and clearances (35) in a certain area against the formed product (20-24) and the contact surfaces have an area that is less than 20% of the area. As a result, this area will be a soft zone (11) of the final product and the zone will have good dimensional accuracy.

19 Claims, 3 Drawing Sheets

22
31 d
35
34
33
30
20

METHOD OF HOT STAMPING AND HARDENING A METAL SHEET

This application is the United States national stage entry of International Application PCT/SE05/01465 filed Oct. 4, 2005, and claims priority to Swedish application 0402382-6 filed Oct. 4, 2004.

TECHNICAL AREA OF THE INVENTION

This invention relates to a method of hot stamping a sheet metal blank to a product in a cooled pair of tools and hardening of the formed product in the pair of tools using them as fixture, wherein both tools of the pair of tools have an area with a clearance to the formed product so that a soft zone is formed in the product.

TECHNICAL BACKGROUND

In the press-hardening process, hardenable boron steel is usually used, and blanks can be formed into very complicated forms and a very high strength can be achieved. The process is used to produce high-strength parts for vehicles, for example bumper beams and side impact guards for doors.

OBJECT OF INVENTION AND BRIEF DESCRIPTION OF THE INVENTION

It is an object of the invention to provide, at a low cost, a soft zone in a press-hardened product without risking the dimensional accuracy even when the soft zone is big. Such soft zones may for example trig and control the buckling of a beam of a vehicle. They may also be used in areas where the ductility need to be increased in order to reduce the risk of cracks. There may also other uses for soft zones.

The invention is characterised in that, in order to get a product that has a good tolerance also in the soft zone, the tools have, in said area, discrete smaller contact surfaces (33,34) to the product, said contact surfaces comprising less than 25% of the area of the soft zone.

DETAILED DESCRIPTION OF THE INVENTION

Figure 1:
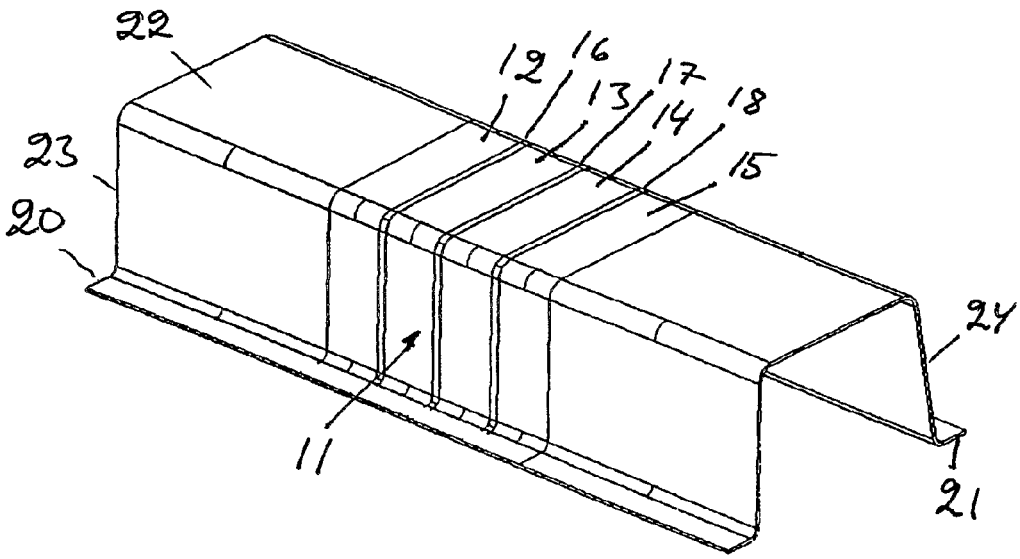
FIG. 1 shows, as an example, a hat beam with a soft zone produced in accordance with the invention.

FIG. 1 shows a product, a hat beam, which has been manufactured in the press-hardening method from a flat metal sheet of hardenable steel, preferably boron steel. The thickness of the sheet is normally 1.5-3 mm. The hat beam consists of a central flange 22, two webs 23,24 and two side flanges 20,21. It has been hardened to an ultra-high strength for example to a tensile strength of 1500 MPa or even higher. Conventionally, the forming tool consists of a fixed lower tool, the die, and the movable upper tool, the punch. The blank is heated to austenitizing temperature and is positioned on the lower tool element. The forming takes a second or two and the formed blank, the product, remains clamped between the pair of tools for a number of seconds more until it has hardened with the tool pair as a fixture.

In FIG. 1, a zone 11 is shown, which is softer, that is, it has a lower strength than the bulk of the hat beam because it has not hardened as much. The zone 11 has four soft bands 12-15 and between them narrow bands or lines 16-18 with higher strength. The narrow bands are shown linear, but they may have any other suitable form and they must not necessarily be continuous. The soft zone 11 results from the fact that the pair of tools have had clearances to the product, the hat beam, which correspond to the softer bands 12-15. The narrow bands 16-18 have higher strength because the pair of tools have contacted the hat beam there so that the cooling has been faster than in the bands 12-15. The contact with the tools in these narrow bands keeps the dimensional tolerances or almost keeps the tolerances in the entire soft zone 11. If these contact surfaces with the tools are narrow, some heating of them from the wider bands 12-15 will occur when the hat beam is removed from the tools, which usually give also these narrow bands 16-18 a somewhat lower strength than the bulk of the hat beam. Normally, the soft zone has contact surfaces to both tools but in some cases it might do to have contact surfaces to only one of the tools in the pair in order to have acceptable dimensional accuracy. The portion contact area in the intended soft zone 11 should be less than 25% or rather less than 20%. It can be less than 10% or rather less than 10% or even less than 2%.

The clearance between tool and product should be at least 0.2 mm and in practice bigger in order to compensate for wear of the tool. Practically, the clearance can be some millimetres in a newly ground tool. The hardness and the strength of the soft zone 11 will usually be 20-80% lower than in the fully hardened material.

The areas 12 and 15 closest to the fully hardened areas will have a noticeable hardening 10-20 millimeters into these areas because of heat transfer from the area with clearance to the tools into the area with full contact with the tools. In order to get a soft zone, the area between large contact surfaces should therefore be at least 40-50 mm. The narrow contact surfaces 16, 17, 18 do not cool much and the affected zones adjacent to them will be narrow. It is desirable to have them as narrow as possible in order to get as small a heat transfer as possible, but too narrow contact surfaces will result in great wear. The dimensional tolerances of the product are reduced with increased distance between the contact surfaces, but by having discrete comparatively narrow contact surfaces as shown, good dimensional tolerances can be achieved also for soft zones with great area. The contact surfaces may suitably have a width smaller than 5 mm, preferably smaller than 2 mm. The relative contact width/clearance width relationship should be less than 20%.

Figure 2:
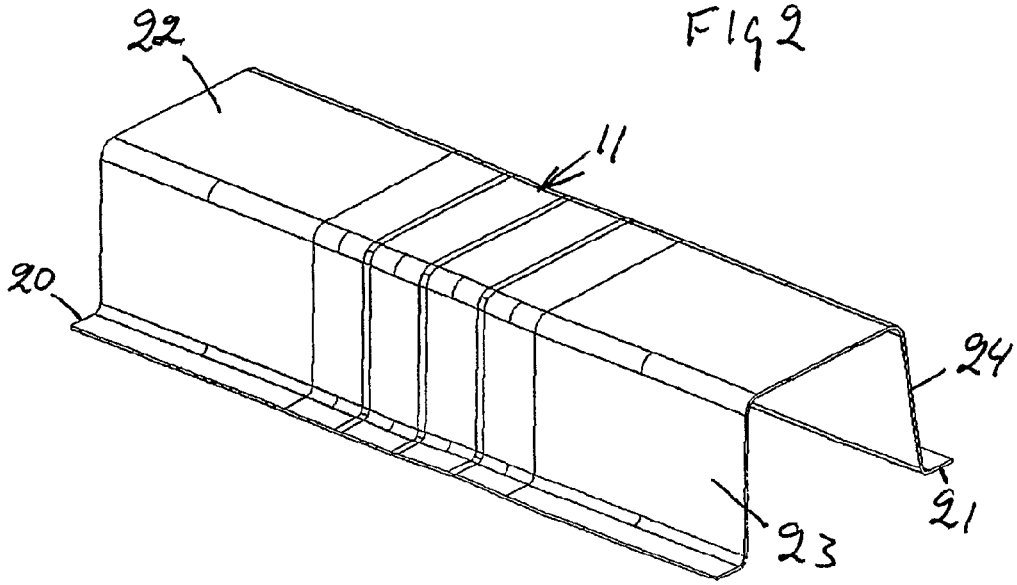
FIGS. 2 and 3 show a similar hat beam with various forms of the soft zone.

FIG. 2 shows the same hat beam, but the soft zone 11 comprises also the side flanges 20,21 of the hat beam in stead of comprising only the central flange 22 and the webs 23,24 as in FIG. 1.

Figure 3:
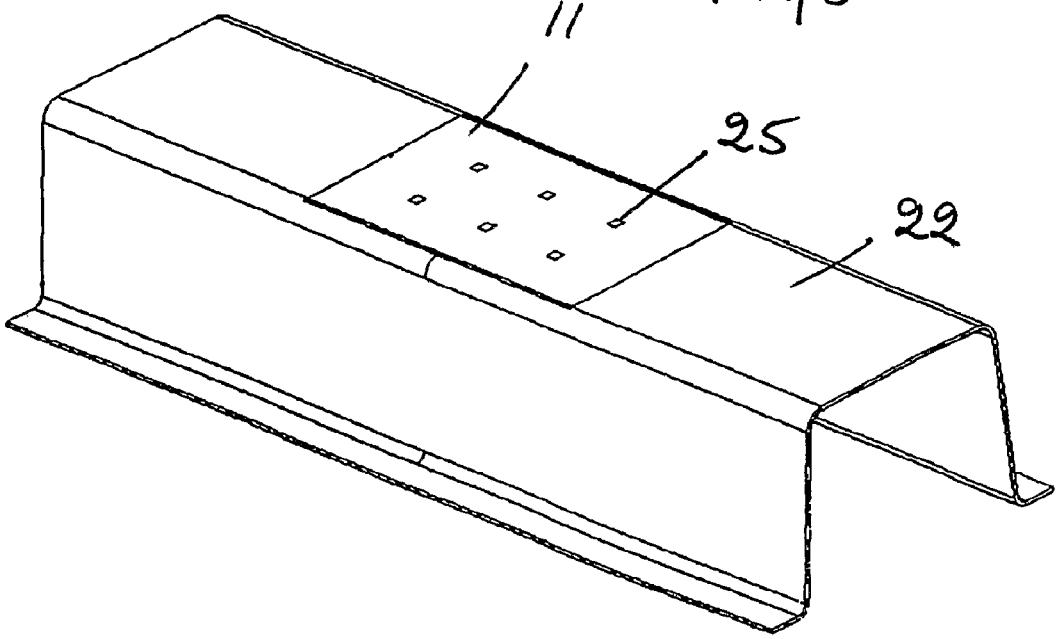

FIG. 3 shows the same hat beam, but the soft zone 11 comprises only the central flange 22. In this example, the tools have not had contact surfaces in the form of stripes, line contact; but have had contact surfaces in the form of small spots to provide for the high dimensional accuracy. In this example, there will be small discrete spots or dots 25 with higher strength than the surrounding soft area. Of course, stripes and spots can be combined in any desirable way for any product.

Figure 4:
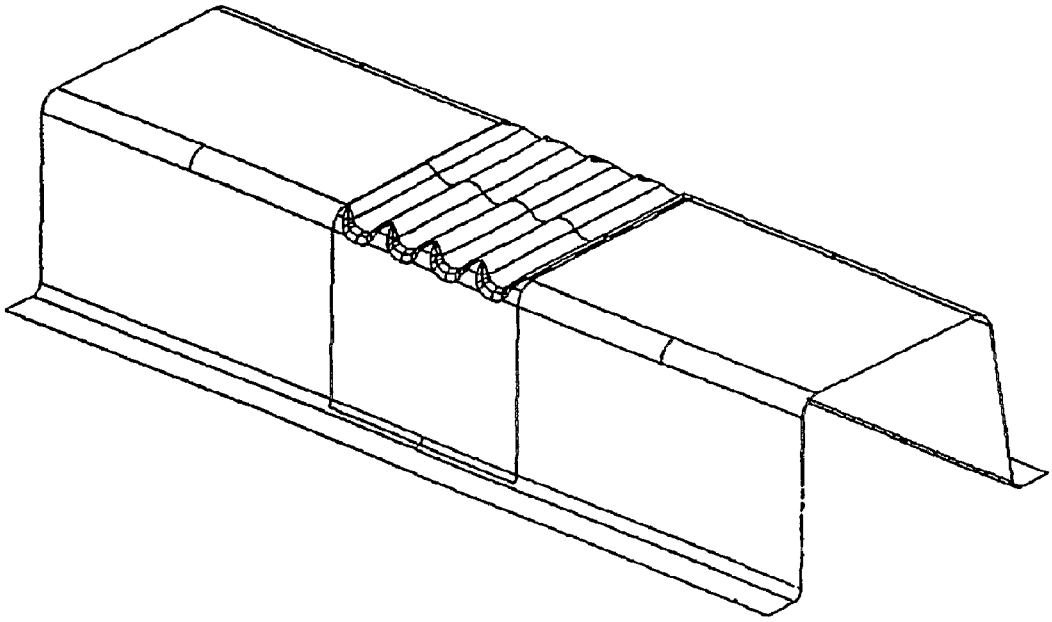
FIG. 4 shows a hat beam with a folded soft zone.

FIG. 4 shows the same hat beam as the preceding figures with a soft zone 11, which, as in FIG. 1, comprises the central flange 22 and the webs 23,24. In this example, the soft zone has been combined with geometrical deformation guides for controlling or trigging a buckling process. The geometrical deformation guides in the form of folds 28 can be achieved by suitable linear contact along the folds. The parts that have had contact with the tools are not indicated in this figure.

Figure 5:
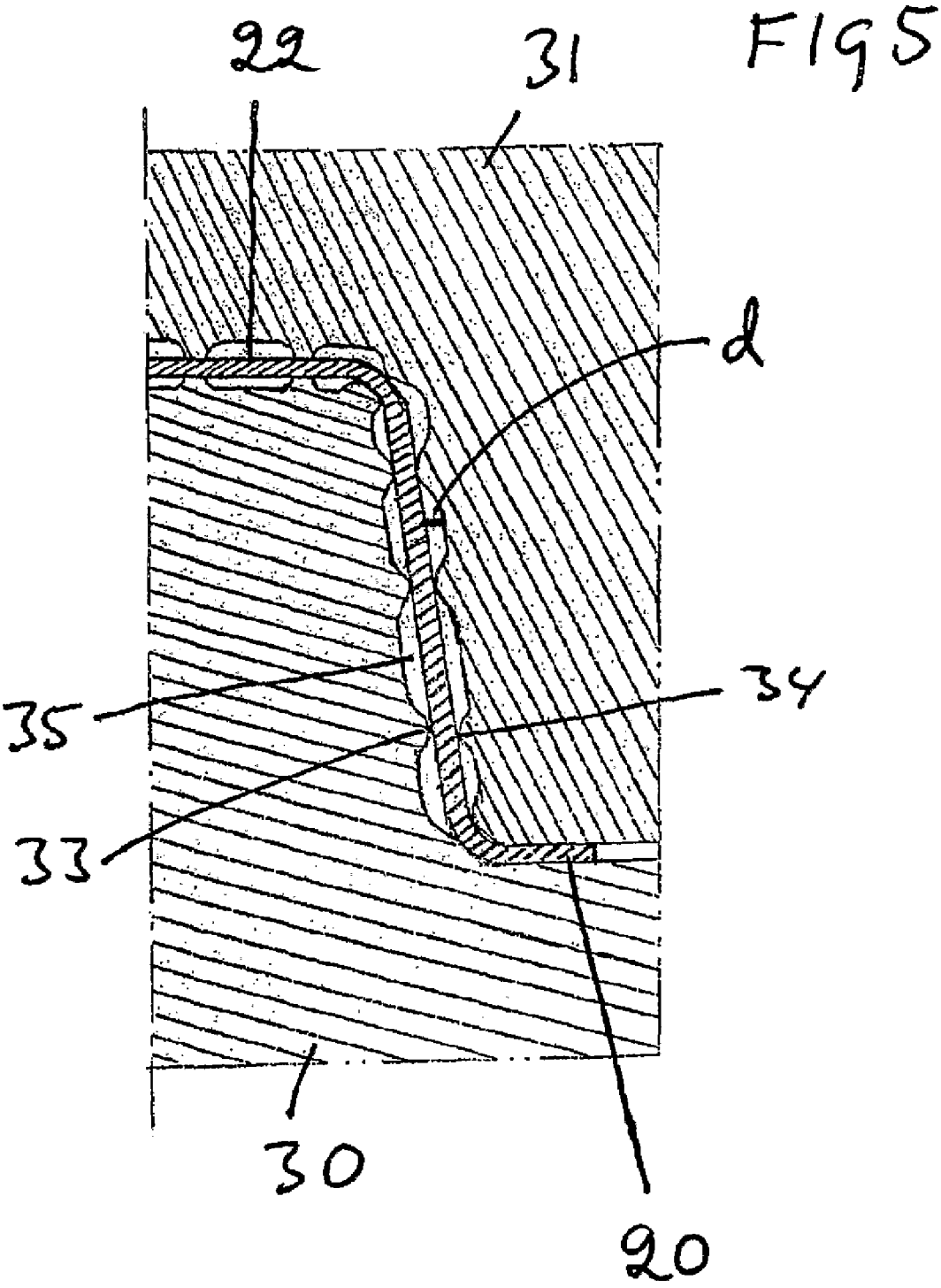
FIG. 5 shows, in a section, a hat beam in a tool that produces a soft zone.

FIG. 5 shows an example of tool design with a lower tool, the die 30, and an upper tool, the punch 31. Both tools of the pair have contact surfaces 33,34, and the clearances 35 has a maximum width d of some millimetres. The contact surfaces may be linear longitudinally in the beam as shown, which provides for a simple tool design. They may alternatively be discrete dots or spots.

The invention can be applied for example to pillars for automotive vehicles, e.g. B-pillars, for trigging the buckling to start in a desired part of the pillar, usually the lower part. In that case, a comparatively large soft zone may be desired. It can also be applied to impact protection beams in vehicle doors, to crash boxes for bumper beams and to other components of automotive vehicles. It can of course not only be applied to automotive vehicles, but it will have a wider use.

The invention claimed is:

1. A method of hot stamping a flat sheet metal blank to a product (20-24) in a cooled pair of tools (30, 31) and hardening of the formed product in the pair of tools using them as fixture, wherein both tools of the pair of tools have an area with a clearance (35) to the formed product so that a soft zone (11) is formed in the product, characterised in that in order to get a product (20-24) that has a good tolerance also in the soft zone (11), the tools have, in said area, discrete smaller contact surfaces (33, 34) to the product, said contact surfaces comprising less than 25% of the area of the soft zone.

2. A method according to claim 1, characterised in that tools are used, in which said contact surfaces (33, 34) comprise less than 20% of the area of the soft zone.

3. A method according to claim 1, characterised in that, tools are used, in which said contact surfaces (33, 34) in said zone are formed as lines.

4. A method according to claim 1, characterised in that, tools are used, in which said contact surfaces (33, 34) in said zone are spots.

5. A method according to claim 1, characterised in that, tools are used, in which said contact surfaces (33, 34) in said zone are less than 5 mm in width.

6. A method according to claim 1, characterised in that, tools are used, in which said contact surfaces (33, 34) in said zone are less than 2 mm in width.

7. A method according to claim 2, characterized in that, tools are used, in which said contact surfaces (33, 34) in said zone are formed as lines.

8. A method according to claim 2, characterized in that, tools are used, in which said contact surfaces (33, 34) in said zone are spots.

9. A method according to claim 2, characterized in that, tools are used, in which said contact surfaces (33, 34) in said zone are less than 5 mm in width.

10. A method according to claim 3, characterised in that, tools are used, in which said contact surfaces (33, 34) in said zone are less than 5 mm in width.

11. A method according to claim 4, characterised in that, tools are used, in which said contact surfaces (33, 34) in said zone are less than 5 mm in width.

12. A method according to claim 7, characterised in that, tools are used, in which said contact surfaces (33, 34) in said zone are less than 5 mm in width.

13. A method according to claim 8, characterised in that, tools are used, in which said contact surfaces (33, 34) in said zone are less than 5 mm in width.

14. A method according to claim 2, characterised in that, tools are used, in which said contact surfaces (33, 34) in said zone are less than 2 mm in width.

15. A method according to claim 3, characterised in that, tools are used, in which said contact surfaces (33, 34) in said zone are less than 2 mm in width.

16. A method according to claim 4, characterised in that, tools are used, in which said contact surfaces (33, 34) in said zone are less than 2 mm in width.

17. A method according to claim 5, characterised in that, tools are used, in which said contact surfaces (33, 34) in said zone are less than 2 mm in width.

18. A method according to claim 7, characterised in that, tools are used, in which said contact surfaces (33, 34) in said zone are less than 2 mm in width.

19. A method according to claim 8, characterised in that, tools are used, in which said contact surfaces (33, 34) in said zone are less than 2 mm in width.

* * * * *